US005189239A

United States Patent [19]

Konishi

[11] Patent Number: 5,189,239

[45] Date of Patent: Feb. 23, 1993

[54] DATA SELECTION APPARATUS FOR ELECTRONIC MUSICAL INSTRUMENT WHICH UTILIZES USE FREQUENCY VALUES TO SELECT MUSICAL DATA

[75] Inventor: Shinya Konishi, Hamamatsu, Japan

[73] Assignee: Kabushiki Kaisha Kawai Gakki Seisakusho, Shinzuoka, Japan

[21] Appl. No.: 671,209

[22] Filed: Mar. 18, 1991

[30] Foreign Application Priority Data

Mar. 19, 1990 [JP] Japan ..... 2-69486

[51] Int. Cl.[5] ..... C10H 7/00; C10H 1/18; C10H 1/22

[52] U.S. Cl. ..... 84/615; 84/618

[58] Field of Search ..... 84/600, 601, 615, 618, 84/653, 656, 617, 655, 670, 477 A, 478

[56] References Cited

U.S. PATENT DOCUMENTS 4,159,663 7/1979 Aoki et al. .
4,512,230 4/1985 Ezawa et al. ..... 84/626
4,747,332 5/1988 Uchiyama et al. ..... 84/655
4,791,847 12/1988 Nishimoto .

FOREIGN PATENT DOCUMENTS 1-139697 6/1989 Japan .

*Primary Examiner*—William M. Shoop, Jr.
*Assistant Examiner*—Jeffrey W. Donels

[57] ABSTRACT

A data selection apparatus for an electronic musical instrument which stores a plurality of kinds of selectable data for generating tones. A selection code is assigned to each data. The code is selected using a selector for performing an incremental operation, and the corresponding selected code is stored in a memory in correspondence with a use frequency. Every time the code is selected, frequency data is updated. One of the stored codes is read out in the order of higher use frequencies, so that corresponding tone generation data can be selected without performing the incremental operation.

24 Claims, 18 Drawing Sheets

KEY BOARD
1
OPERATION PANEL
2
20
+1
-10
+10
-1
SOUND1
SOUND2
SOUND3
2a
2d
2b
2c
2e
2f
2g
CPU
3
TIMER
4
PGM/DATA ROM
5
DATA/ WORKING RAM
6
TONE GENERATOR CKT
7
8
D/A

FIG. 3

| | |
|---|---|
| KEY WORK. REG | KEY |
| PANEL WORK. REG | PNL |
| DSPL DATA REG | LEDREG |
| OPERATION REG | TWORK1 |
| OPERATION REG | TWORK2 |
| STATUS REG | SREG0 |
| STATUS REG | SREG1 |
| TONE COLOR REG | SND |
| FREQ. REG | TWORK3 |
| NUMBER REG | TWORK4 |
| COUNTER | CNT0 |
| COUNTER | CNT1 |
| COUNTER | CNT2 |
| TONE COLOR ASSIGN. MEM | TARAM |

(a)

TARAM

| TONE COLOR NO. | FREQ. |
|---|---|
| 0 5 | 0 5 |
| 1 0 | 0 4 |
| 1 5 | 0 3 |
| 0 0 | 0 0 |
| | |
| | |
| 0 0 | 0 0 |

(b)

TARAM

| TONE COLOR NO. | FREQ. |
|---|---|
| 0 5 | 0 5 |
| 1 0 | 0 4 |
| 1 5 | 0 3 |
| 2 3 | 0 1 |
| | |
| | |
| 0 0 | 0 0 |

(a)

TARAM

| TONE COLOR NO. | FREQ. |
|---|---|
| 05 | 05 |
| 10 | 04 |
| 15 | 03 |
| 00 | 00 |
| | |
| 00 | 00 |

(b)

TARAM

| TONE COLOR NO. | FREQ. |
|---|---|
| 05 | 05 |
| 10 | 04 |
| 15 | 03 |
| 00 | 01 |
| | |
| 00 | 00 |

DATA SELECTION APPARATUS FOR ELECTRONIC MUSICAL INSTRUMENT WHICH UTILIZES USE FREQUENCY VALUES TO SELECT MUSICAL DATA

BACKGROUND OF THE INVENTION

1. Field of the Invention

The present invention relates to a data selection apparatus for an electronic musical instrument which stores a plurality of selectable data in association with control factors for controlling tones or music pieces such as tone color data, rhythm data, auto-accompaniment pattern data, and the like.

2. Description of the Prior Art

Recently, an electronic musical instrument which stores a large number of selectable tone color and rhythm data is available. In an electronic musical instrument of this type, for example, a two digit number assigned to each data is input to select the corresponding data.

In this case, for example, as shown in FIG. 2, four push buttons 2*a* to 2*d* for independently incrementing-/decrementing a ones digit and a tens digit are arranged on an operation panel 2 of the electronic musical instrument, and a user inputs a number corresponding to desired data by continuously incrementing/decrementing numerical values in units of digits upon depression of the push buttons 2*a* to 2*d*.

The input number is displayed on, e.g., a display unit 20 arranged on the operation panel 2.

However, when the instrument stores a large number of data as described above, if a number is selected by continuously incrementing/decrementing numerical values, a target data number cannot often be quickly selected.

In particular, for some users, data frequently used is almost fixed. However, in this case, in a conventional electronic musical instrument, a number must be continuously changed to call target data, resulting in time-consuming and cumbersome target data selecting operations.

SUMMARY OF THE INVENTION

It is an object of the present invention to provide a data selection apparatus for an electronic musical instrument which can easily and quickly select data which is frequently used by a user.

According to one aspect of the present invention, as shown in a fundamental block diagram of FIG. 1, in an electronic musical instrument which stores a plurality of kinds of selectable data for generating tones, a selection code is assigned to each data, and one selection code is selected by a select operation means 101. The selected selection code is stored in a selection code memory 102 in correspondence with its use frequency. The selection codes stored in the selection code memory 102 are read out in the order of higher use frequencies by a selection code read means 104. The selection code obtained upon operation of one of the select operation means 101 and the selection code read means 104 is assigned to a tone generator by an assignment means 105. The use frequency of the assigned selection code is updated by a frequency updating means 106, and is registered in the memory 102. The selection code to be assigned is displayed on a display 108.

According to another aspect of the present invention, a read operation means 103 for operating the read means 104 is commonly used as the select operation means 101. A operation detection means 110 detects an operation state of these operation means to be commonly used, and determines which means is operated. The select operation means 101 comprises buttons 2*a* and 2*c* for incrementing and decrementing a ones digit of a two-digit selection code one by one, and buttons 2*b* and 2*d* for incrementing and decrementing a tens digit one by one. The buttons 2*a*-2*d* are commonly used as the select operation means 101 and the read operation means 103.

When the read operation means 103 for instructing read access from the selection code memory 102 is operated, a predetermined number of selection codes of data which were previously used by a user are read out in the order of higher frequencies and are displayed on the display 108. When the user wants to use data corresponding to the displayed selection code, he or she leaves them for a predetermined period of time, or operates a specific operation member to fix the selection. The selection is fixed by the assignment means 105.

BRIEF DESCRIPTION OF THE DRAWINGS

FIG. 3 is a table showing contents of a data/work RAM in the embodiment;

FIGS. 4A and 4B to FIGS. 8A and 8B are explanatory views for explaining operations of selectors and contents of a tone color assign memory in the embodiment.

DETAILED DESCRIPTION OF THE PREFERRED EMBODIMENT

An embodiment in which the present invention is applied to a tone color selection apparatus in an electronic musical instrument such as a synthesizer will be described below with reference to FIGS. 2 to 18.

Figure 1:
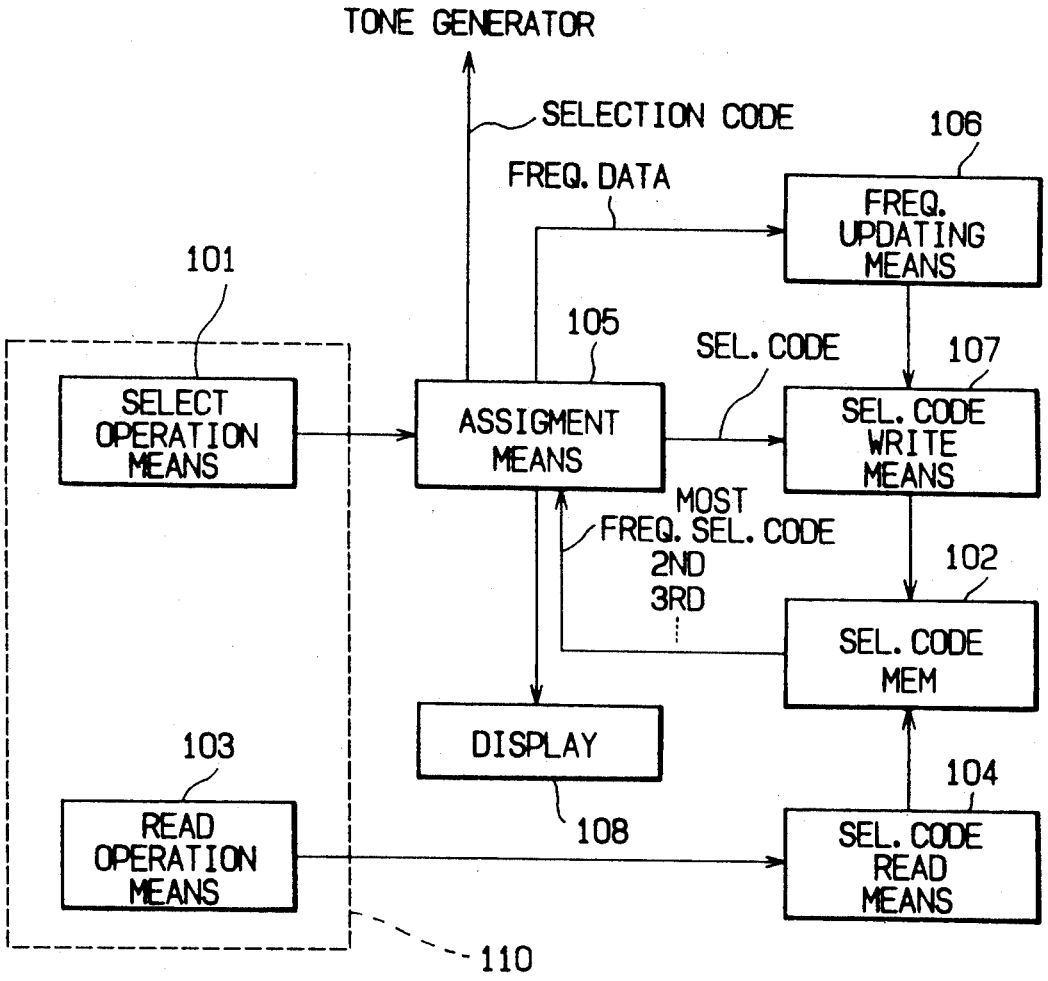
FIG. 1 is a block diagram showing an arrangement of the present invention.
Figure 2:
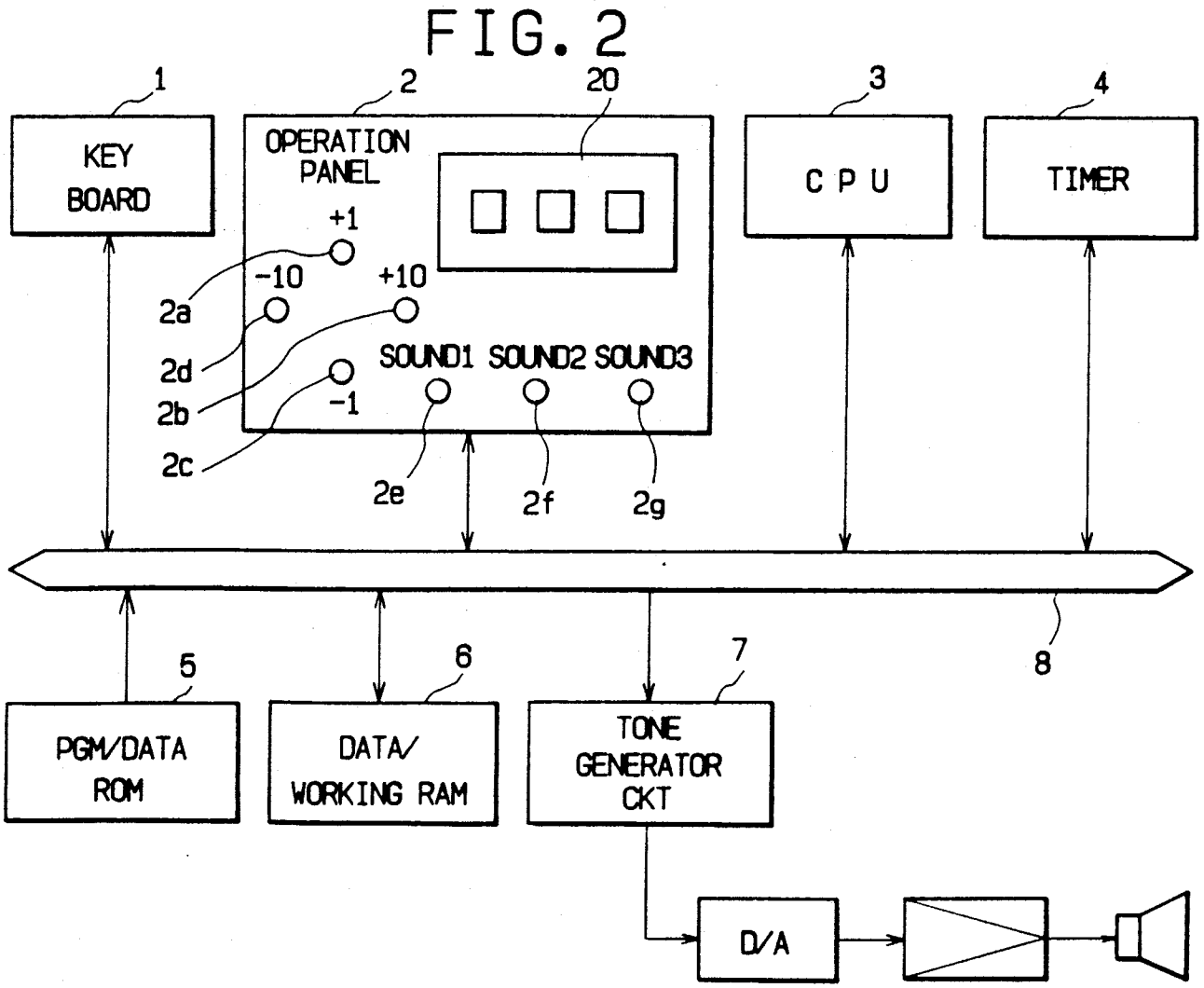
FIG. 2 is a block diagram showing a circuit arrangement of an electronic musical instrument according to an embodiment of the present invention.

FIG. 2 schematically shows an arrangement of an electronic musical instrument of this embodiment.

As shown in FIG. 2, the electronic musical instrument of this embodiment comprises a keyboard unit 1, an operation panel 2, a CPU 3, a timer 4, a ROM 5 for storing a program and various data, a RAM 6 serving as a data RAM, a work RAM, and the like, and a tone generator circuit 7.

The keyboard unit 1 comprises a keyboard including a plurality of keys for designating tones, and ON-event data of the respective keys are detected by scan processing of the CPU 3.

The operation panel 2 is provided with various buttons for controlling tones and a performance, and a display unit 20 including LEDs for displaying a tone control state and a performance control state. The operation states of the buttons are detected by the scan processing of the CPU 3.

The CPU 3 executes various processing operations such as tone generation, reproduction of an auto-accompaniment apparatus, keyboard scan processing, operation panel scan processing, and the like in accordance with the program stored in the program/data ROM 5.

The timer 4 outputs various request signals such as a request signal for switching parameters to be displayed on the display unit 20, a request signal for selecting a display digit, and the like, and timing signals to respective units.

The program/data ROM 5 stores the program for the CPU 3, tone waveform data, auto-accompaniment performance data, LED display data, and the like.

The data/work RAM 6 comprises a battery backed-up RAM or a nonvolatile RAM, and has a key work register KEY necessary for detecting events of the respective keys on the keyboard unit 1, a panel work register PNL necessary for detecting events of the buttons of the operation panel 2, a display data register LEDREG for storing a display content to be displayed on the display unit 20, two operation registers TWORK1 and TWORK2 for operating display values, a status register SREG0 indicating the presence/absence of various request signals, a status register SREG1 indicating states of the various buttons, a tone color register SND for storing numbers of tone colors to be actually produced, a frequency register TWORK3 for temporarily storing a use frequency of a tone color number read out from a tone color assign memory TARAM (to be described later) when a tone color number is written in the tone color assign memory TARAM, a tone color number register TWORK4 for temporarily storing the readout tone color number, a counter CNT0 for adjusting output timings of the various request signals, a counter CNT1 for counting ON times of selectors (to be described later), a counter CNT2 for counting a time from an OFF event of each selector until the number selection is fixed, the tone color assign memory TARAM (to be described later), and the like, as shown in FIG. 3.

The tone generator circuit 7 forms and outputs a tone signal under the control of the CPU 3. A tone signal output from the tone generator circuit 7 is supplied to a loudspeaker via a D/A converter and an amplifier.

The keyboard unit 1, the operation panel 2, the CPU 3, the timer 4, the program/data ROM 5, the data/work RAM 6, and the tone generator circuit 7 are connected to a common bus line 8 to communicate with each other.

In this embodiment, four push buttons (to be referred to as "selectors" hereinafter) 2*a* to 2*d* for selecting tone color numbers are arranged on the operation panel 2.

The electronic musical instrument of this embodiment stores, e.g., 100 different selectable tone color data. Different two-digit numbers are assigned to these tone color data. A user designates a two-digit number upon operation of the selectors 2*a* to 2*d*, thereby selecting a desired tone color.

The four selectors 2*a* to 2*d* as incremental/decremental buttons include the selector 2*a* for incrementing a ones digit, the selector 2*b* for incrementing a tens digit, the selector 2*c* for decrementing a ones digit, and the selector 2*d* for decrementing a tens digit. A number designated upon operation of these selectors 2*a* to 2*d* is displayed on the display unit 20.

The operation panel 2 is provided with push buttons 2*e* to 2*g* for selecting melody, bass, and chord parts, i.e., tone color series.

ON and OFF events of the selectors 2*a* to 2*d* for designating the tone color numbers are detected by known panel scan processing of the operation panel 2. When one selector is kept depressed, a numerical value of a digit corresponding to the selector is continuously incremented/decremented. Note that a tone color is actually changed when an OFF event of the selectors 2*a* to 2*d* is detected.

More specifically, every time the selectors 2*a* to 2*d* are intermittently operated at short intervals, a tone color is changed accordingly. When the selectors 2*a* to 2*d* are continuously operated, i.e., when the selectors 2*a* to 2*d* are kept depressed, a displayed number is changed, but an actual tone color is left unchanged. When the selectors 2*a* to 2*d* are released, a tone color is switched to the one displayed at that time.

In the electronic musical instrument of this embodiment, the selector 2*a* for incrementing a ones digit has a special function. More specifically, the remaining selectors 2*b* to 2*d* have only a numerical value incrementing-/decrementing function. In contrast to this, when the selector 2*a* for incrementing a ones digit is depressed under a given condition, a predetermined number of (e.g., 10) tone color numbers which were previously used are displayed on the display unit 20 in the order of higher use frequencies. When the selector 2*a* is depressed again after the ten tone color numbers are displayed, or when the selector 2*a* is kept depressed, a numerical value of the ones digit of the number which is finally displayed is incremented.

The above-mentioned operation will be described in detail below with reference to FIGS. 4A to 8B.

Figure 4A:
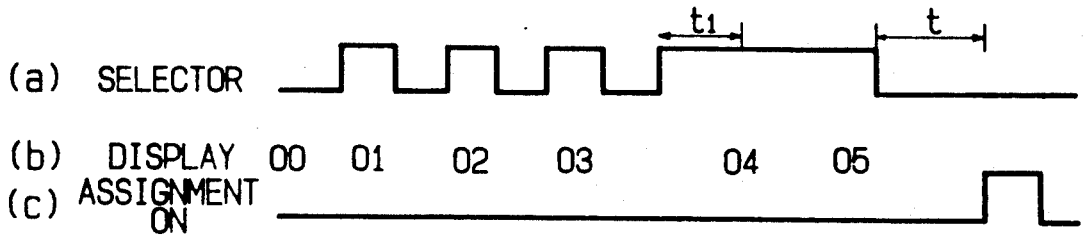
Figure 4B:
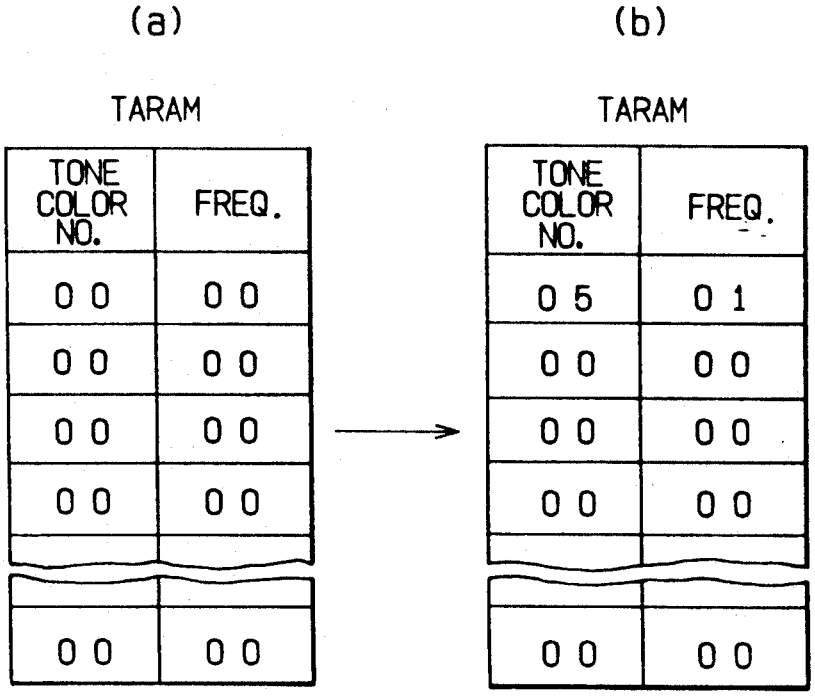

FIGS. 4A and 4B show cases wherein the selector 2*a* is operated in an initial state after a power switch is turned on. FIG. 4A(a) time-serially shows changes in ON and OFF states of the selector 2*a*. In the initial state, a display of the display unit 20 is "00". When the selector 2*a* is depressed once in this state, a display is switched to "01", as shown in FIG. 4A(b). When the selector 2*a* is intermittently operated, the ON events of the selector 2*a* are detected, and the display is sequentially switched like →"02"→"03" in response to each ON event. Meanwhile, an actual tone color is changed every time an OFF event of the selector 2*a* is detected. When the selector 2*a* is kept depressed, the ON state of the selector 2*a* is detected, and its ON time is counted. Every time a predetermined time $t_1$ elapses, the display is sequentially switched like→"04"→"05". In this case, an actual tone color is directly switched to a tone color of a number displayed when the selector 2*a* is released, e.g., of "05 ".

FIGS. 4B(a) and 4B(b) show contents of the tone color assign memory TARAM as a portion of a storage area of the data/work RAM 6 shown in FIG. 3. The tone color assign memory TARAM stores 10 selection-fixed tone color numbers and their use frequencies (the number of times of selections) in the order of higher use frequencies. FIG. 4B(a) shows an initial state, and no tone color number is stored yet.

In this embodiment, when the selectors 2*a* to 2*d* are intermittently operated at short intervals, it is determined that the number selection is fixed only after an elapse of a predetermined time t from an OFF event of one of the selectors 2*a* to 2*d*, so as to prevent that all the displayed numbers are written in the tone color assign memory TARAM although the numbers are still in selection.

FIG. 4A(c) shows an assign operation for writing a tone color number and its use frequency in the tone color assign memory TARAM. As shown in FIG. 4A(c), this assign operation is enabled (ON) after an elapse of the predetermined time t from the OFF event of the selector 2a. In FIG. 4A, a number "05" is selected, and its selection is fixed. Therefore, as shown in FIG. 4B(b), the tone color number "05" is written at the first address of the tone color assign memory TARAM, and a use frequency "01" is written in the corresponding column of "frequency".

Figure 5A:
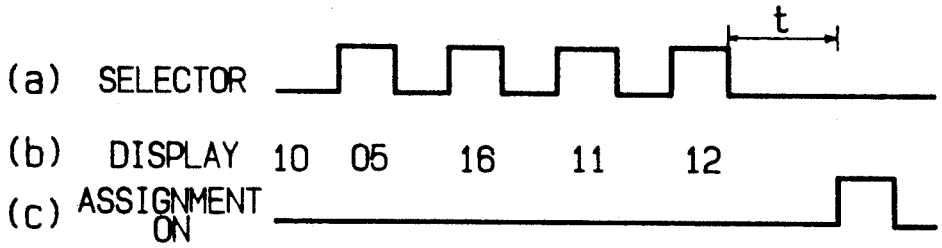
Figure 5B:
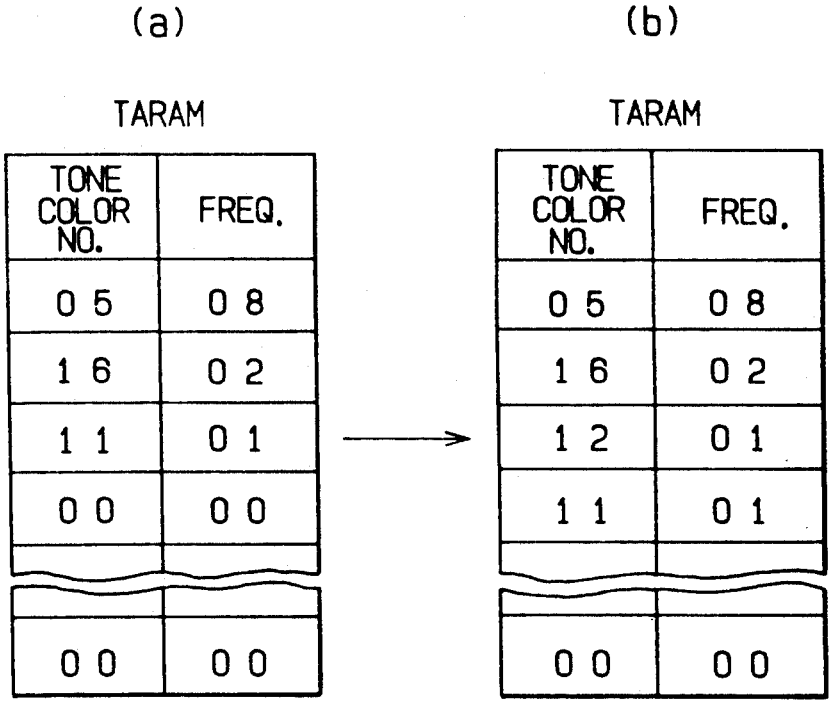

FIGS. 5A and 5B show a case wherein the selector 2a is operated after some tone color numbers are stored in the tone color assign memory TARAM. In this case, as shown in FIG. 5B(a), three tone color numbers "05" (use frequency "08"), "16" (use frequency "02"), and "11" (use frequency "01") are stored in the tone color assign memory TARAM. Before the selector 2a is operated, a number "10" is displayed on the display unit 20.

When the selector 2a is operated once in this state, as shown in FIG. 5A(b), a display is directly switched from "10" to "05". When the selector 2a is intermittently operated or is continuously operated, the display is sequentially switched like →"16"→"11". More specifically, when the selector 2a is operated in a state wherein tone color numbers are stored in the tone color assign memory TARAM, the tone color numbers stored in the tone color assign memory TARAM are read out in the order of addresses, i.e., in the order of higher use frequencies, and are displayed on the display unit 20.

If a user wants to select one of the displayed tone color numbers, he or she need only leave the display state of the desired number for the predetermined time t. If the user cannot find a target tone color among the displayed numbers, he or she further depresses the selector 2a. Then, as shown in FIG. 5A(b), the ones digit of the finally displayed number "11" is incremented by one, and a displayed number is switched to "12". When the selector 2a is further depressed or is kept depressed, the displayed number is sequentially changed like →"13"→"14"→.

Assuming that a user wants to select a tone color of the number "12", he or she leaves a state wherein the number "12" is displayed on the display unit 20 for the predetermined time t, as shown in FIG. 5B(b). Thus, as shown in FIG. 5A(c), the assign operation is enabled, and selection of the number is fixed. The tone color number is then written in the tone color assign memory TARAM, as shown in FIG. 5B(b).

In this case, since the tone color number "12" is selected for the first time, its use frequency is "01". The tone color number "12" is written at an address smaller by one than the address of the tone color number "11" having the same use frequency "01", as shown in FIG. 5B(b). More specifically, the tone color number "11" is moved to the next address, and the new tone color number "12" is written at the address where the tone color number "11" has been stored.

In this embodiment, for tone color numbers having the same use frequency, the latest selected number is always stored at the smaller address.

When the use frequency of a tone color number stored at the last address of the tone color assign memory TARAM is "01", and a new tone color number which is not stored in the tone color assign memory TARAM yet is selected, the newly selected tone color number is stored at the last address or at a predetermined address before the last address. In addition, tone color numbers stored after the write address are shifted to larger addresses, and the tone color number stored at the last address is deleted.

Figure 6A:
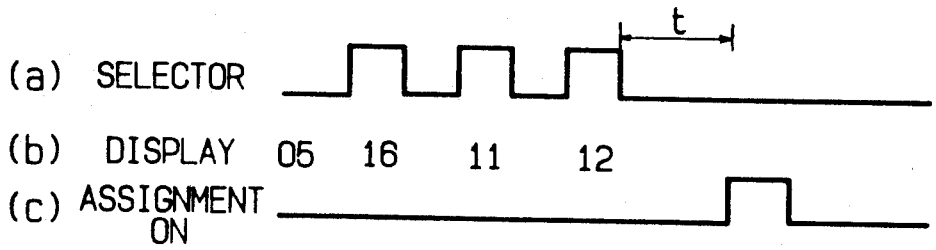
Figure 6B:
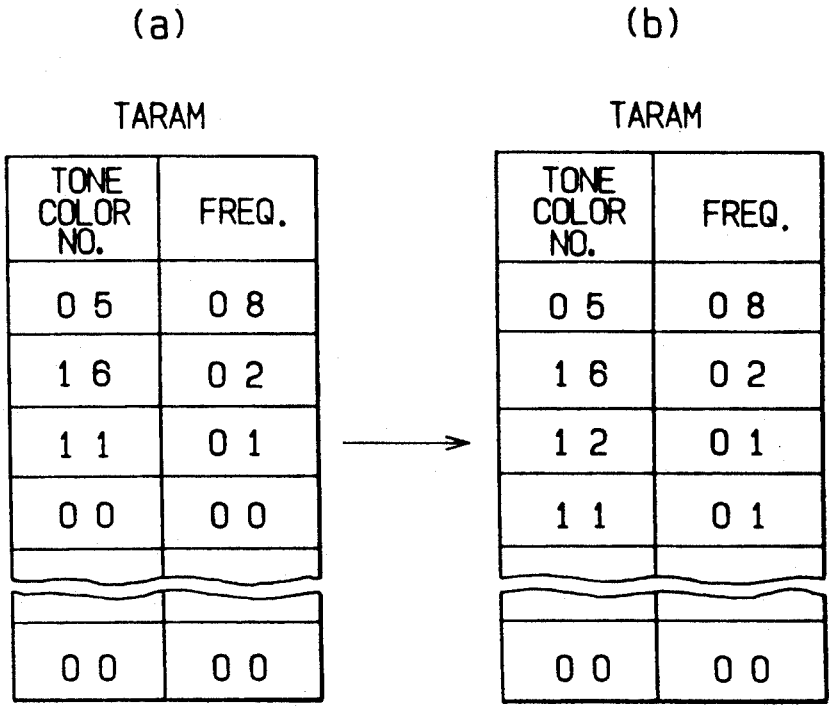

FIGS. 6A and 6B show a case wherein the tone color number stored at the start address of the tone color assign memory TARAM coincides with the number displayed at that time. In this case, as shown in FIG. 6A(b), when the selector 2a is operated once, a display is immediately changed from, e.g., a displayed number "05" which is the same as the tone color number stored at the start address of the tone color assign memory TARAM to a tone color number "16" stored at the second address. That is, the tone color number "05" which is displayed first is never repetitively displayed.

Figures 7A, 7B:
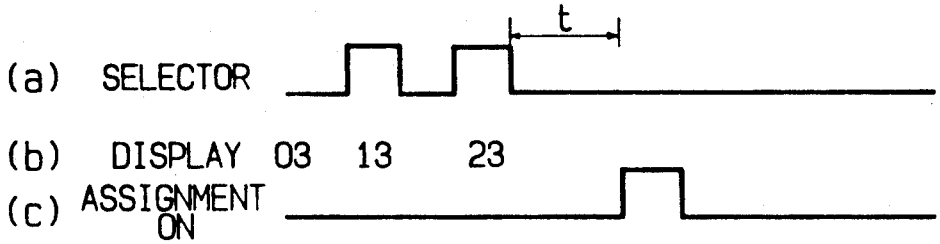

FIGS. 7A and 7B show a case wherein the selector 2b is operated to increment a tens digit. The selector 2b is a button for merely incrementing a numerical value. When the selector 2b is intermittently or continuously operated, a display is changed like "03"→"13"→"23", as shown in FIG. 7A(b). When the predetermined time t passes after the OFF event of the selector 2b, the assign operation is enabled, and selection of the number is fixed, as shown in FIG. 7A(c). The same applies to the selector 2d for decrementing the tens digit.

Figures 8A, 8B:
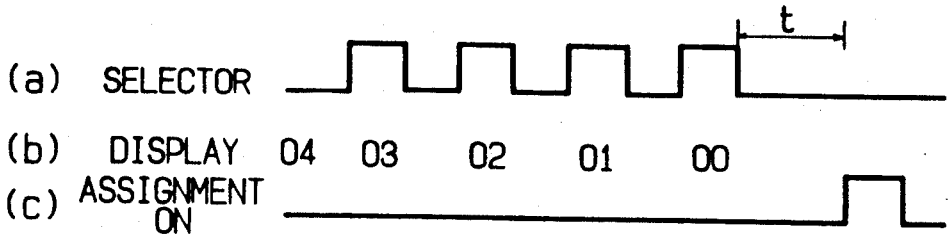

FIGS. 8A and 8B show a case wherein the selector 2c for decrementing a ones digit is operated. In this case, when the selector 2c is intermittently or continuously operated, a display is changed like "04"→"03"→"02"→"01"→"00", as shown in FIG. 8A(b). When the display reaches "00", the numerical value can no longer be decremented even when the selector 2c is operated.

The above-mentioned read operation of the tone color assign memory TARAM upon operation of the selector 2a is performed only when the selector 2a is operated under a given condition. As will be described later, the read operation is performed only when the selector 2a is operated after an elapse of the predetermined time t from an operation of a given selector. Therefore, when the selector 2a is operated before the predetermined time t elapses after at least one of the remaining selectors 2b to 2d are operated, only a normal numerical value incrementing function is available.

The reason why such an arrangement is adopted is that the purpose of operation of the selector 2a immediately after the operations of the remaining selectors 2b to 2d is usually not to read out previously used tone color numbers, but to merely perform normal number change processing, i.e., to change a numerical value of a number by "+1".

The operations of the electronic musical instrument of this embodiment will be described below with reference to the flow charts shown in FIGS. 9 to 18.

Figure 9:
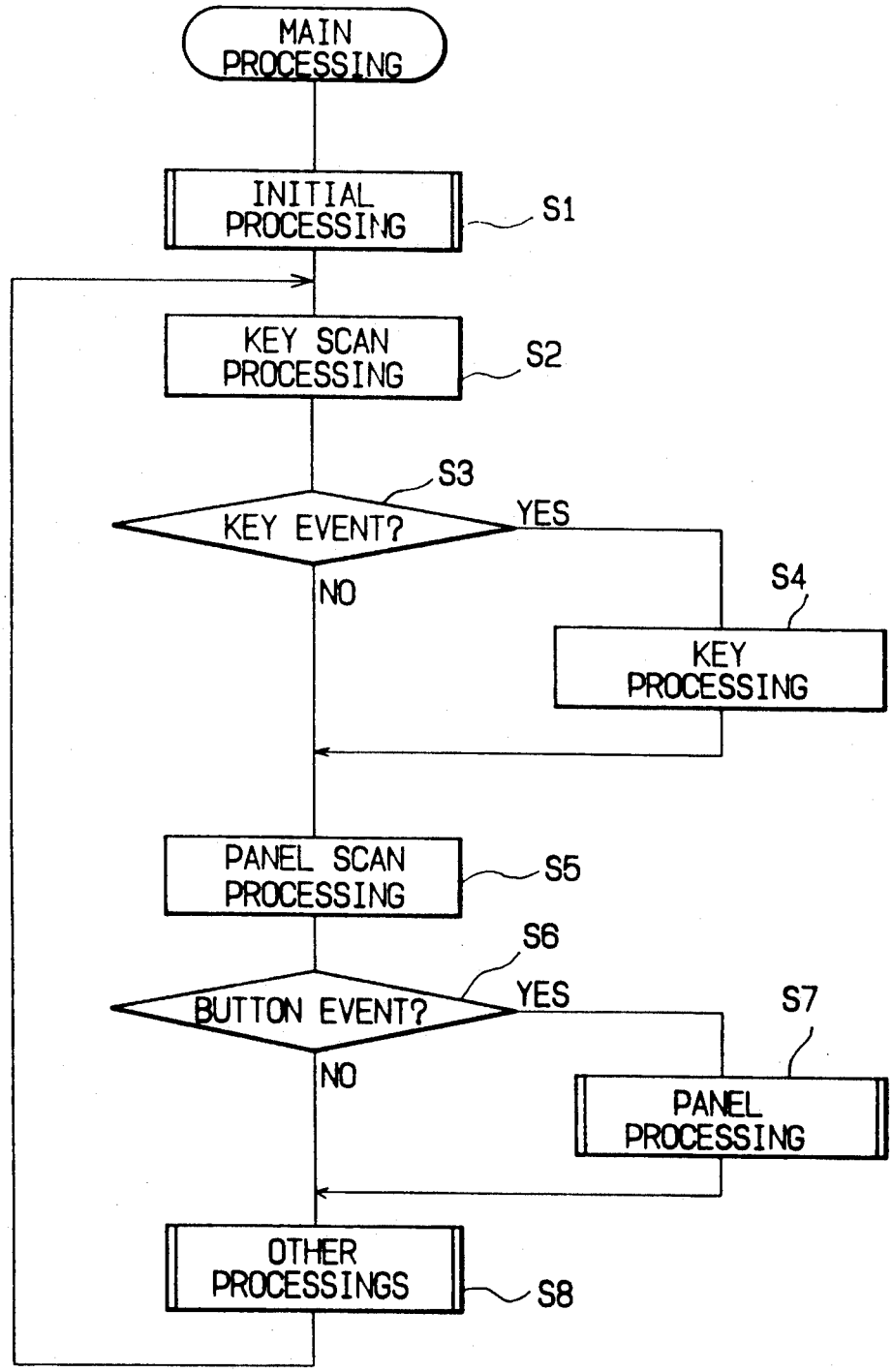
FIGS. 9 to 18 are flow charts for explaining the operations of the electronic musical instrument of the embodiment.

FIG. 9 is a flow chart showing a processing sequence of main processing executed by the CPU 3 shown in FIG. 2.

Figure 10:
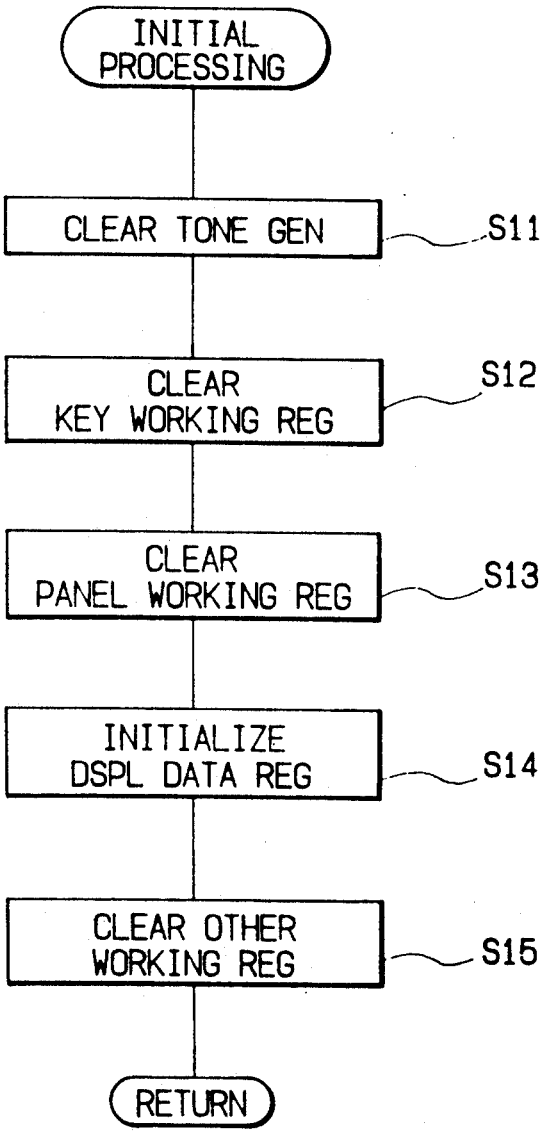

When the power switch of this electronic musical instrument is turned on, the CPU 3 executes initial processing shown in FIG. 10 in step S1.

In step S2, the CPU 3 executes key scan processing for checking operation states of all the keys (key events) of the keyboard unit 1. If a key event is detected in step S3, the flow advances to key processing in step S4, and processing for sending tone control data according to the key event to the tone generator circuit 7, or the like is executed.

In step S5, panel scan processing for checking operation states of all the buttons (button events) of the operation panel 2 is executed. If a button event is detected in step S6, panel processing (see FIG. 11) according to the button event is executed in step S7. In step S8, other main processing operations (see FIG. 14; to be described later) are executed, and the flow returns to step S2.

FIG. 10 is a flow chart showing a subroutine of the initial processing (step S1) in the main processing shown in FIG. 9.

In this processing, in step S11, a tone generator (sound source; not shown) is initialized. In step S12, the key work register KEY of the data/work RAM 6 shown in FIG. 3 is cleared, and in step S13, the panel work register PNL is cleared. In step S14, the display data register LEDREG is initialized. In step S15, other work registers are cleared. The flow then returns to the main routine shown in FIG. 9.

Figure 11:
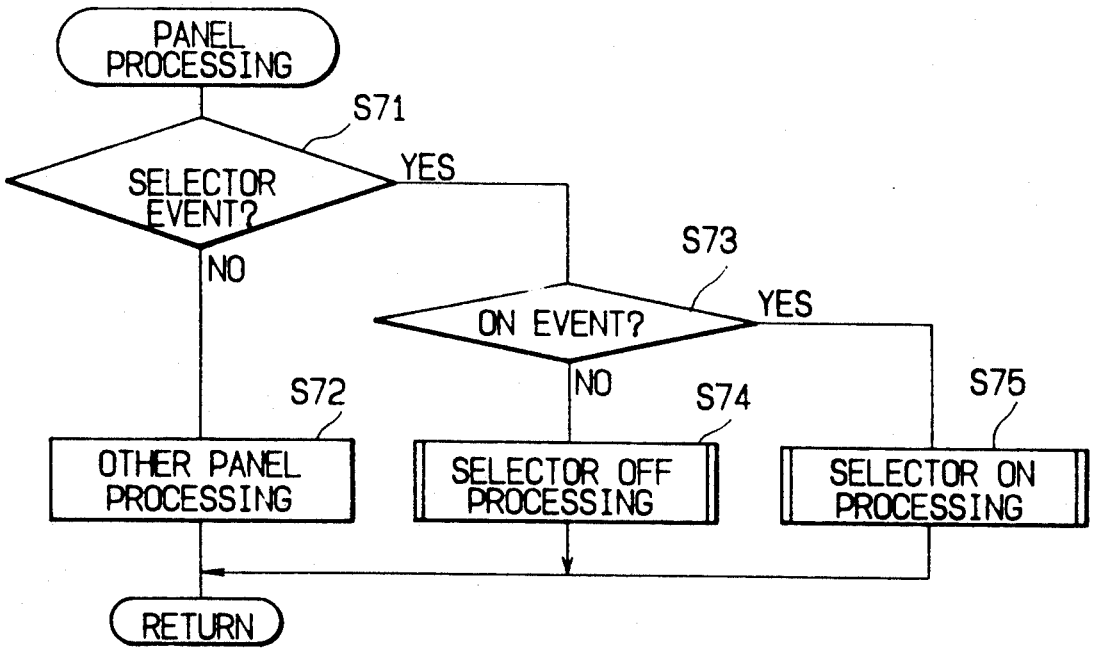

FIG. 11 is a flow chart showing a subroutine of the panel processing (step S7) in the main processing shown in FIG. 9.

In this processing, it is checked in step S71 if operation states of the selectors 2*a* to 2*d* are changed. If NO in step S71, other panel processing operations are executed in step S72, and the flow then returns to the main routine shown in FIG. 9.

However, if it is determined in step S71 that the operation state of one of the selectors 2*a* to 2*d* is changed, the flow advances to step S73 to check if the change is an ON event. If NO in step S73, since the change is an OFF event, the flow advances to step S74 to execute selector OFF processing (see FIG. 12; to be described later). Thereafter, the flow returns to the main routine. On the other hand, if it is determined that the change in operation state of the selector is an ON event, the flow advances to step S75 to execute selector ON processing (see FIG. 13; to be described later). Thereafter, the flow returns to the main routine.

Figure 12:
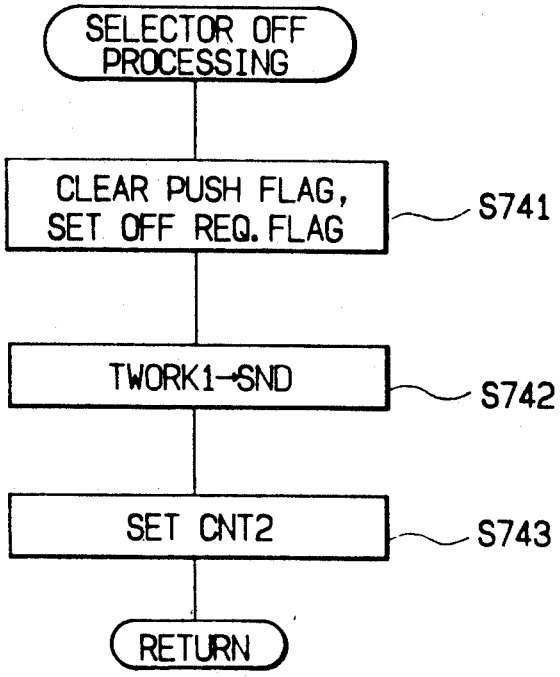

FIG. 12 is a flow chart showing a subroutine of the selector OFF processing (step S74) in the panel processing in FIG. 11.

Figure 13:
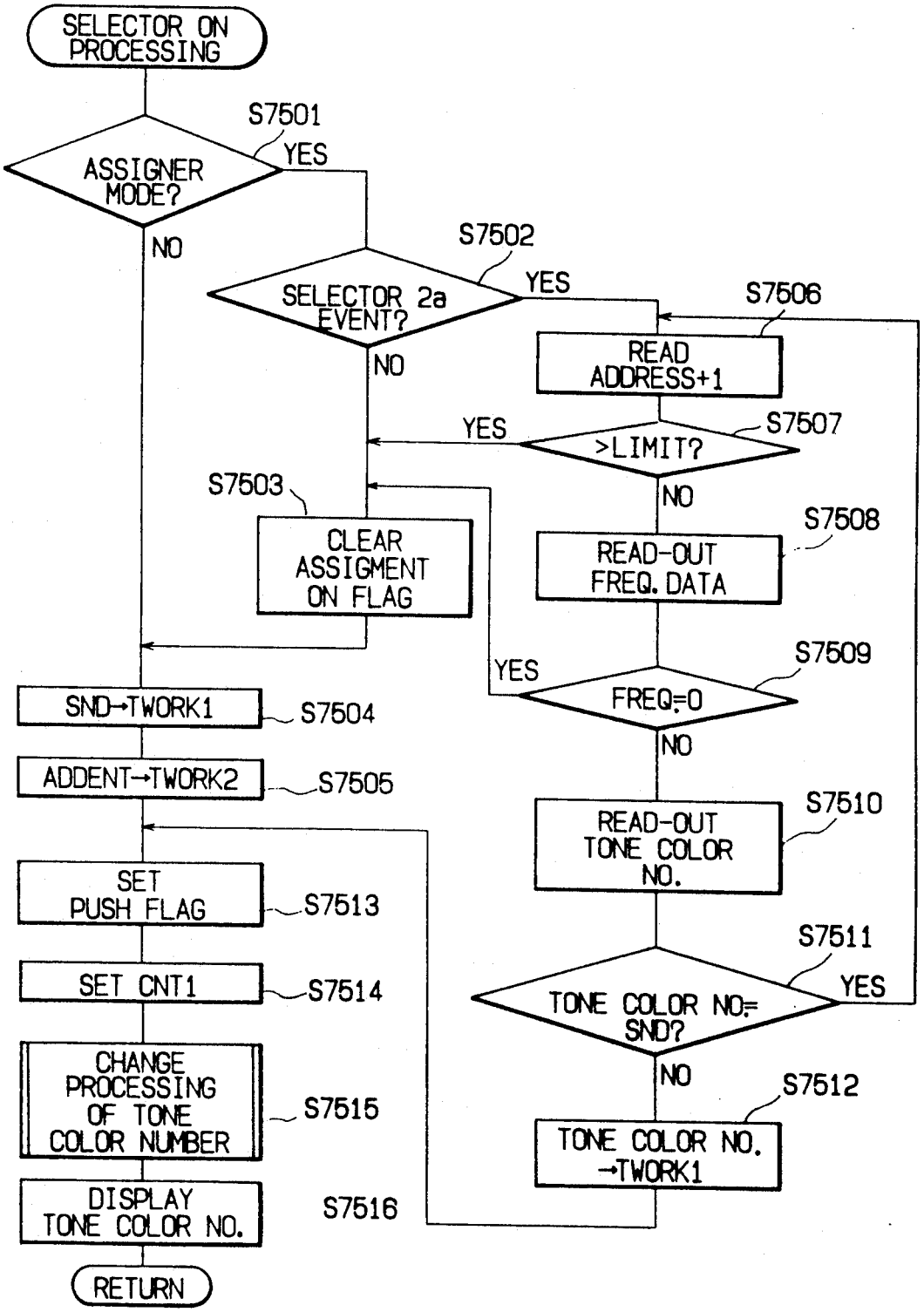
Figure 18:
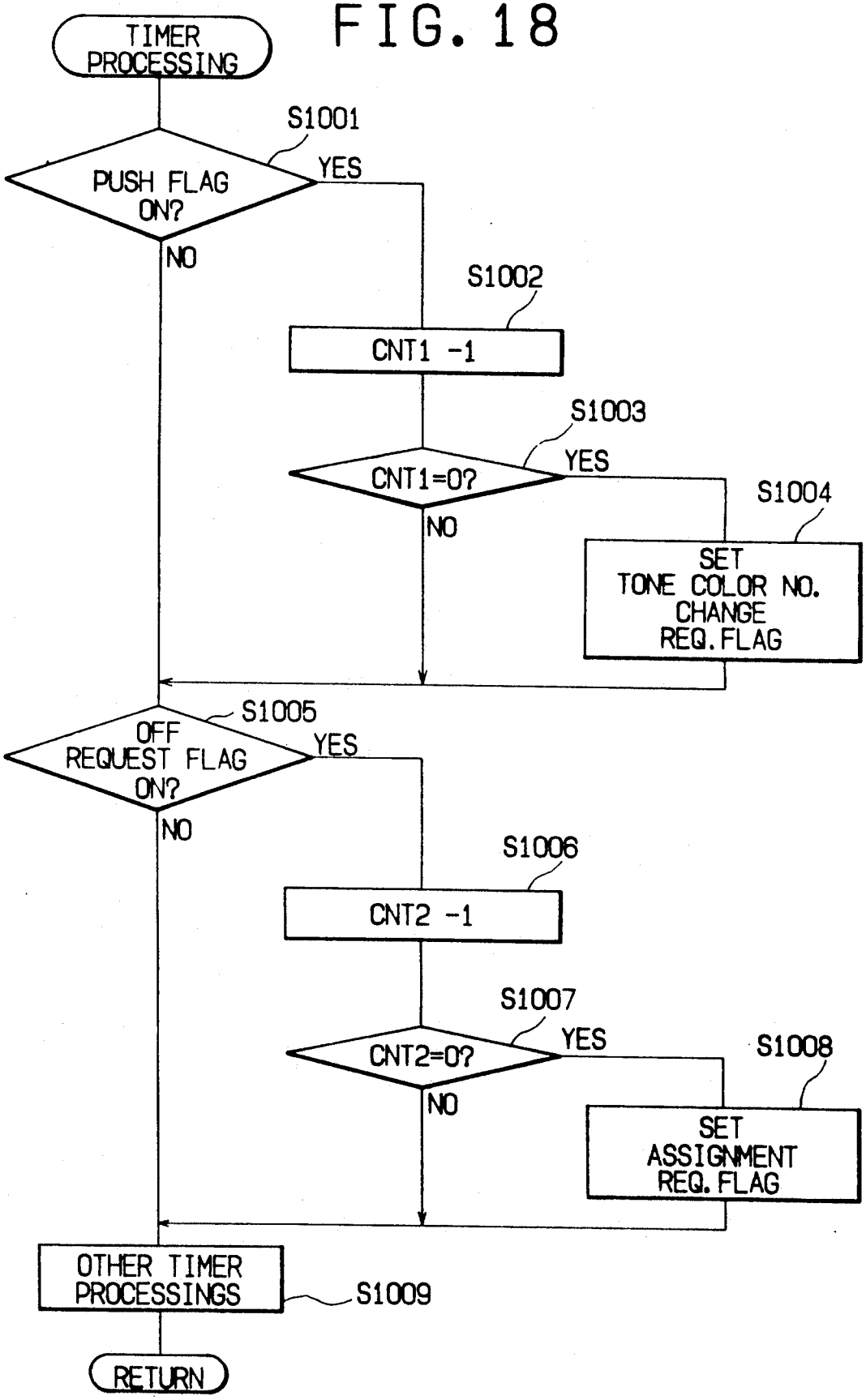

In this processing, in step S741, a PUSH flag set in the selector ON processing in FIG. 13 is cleared, and an OFF request flag is set (status register SREG1). The OFF request flag is used to operate the counter CNT2 for fixing selection of a tone color number in timer processing (FIG. 18; to be described later).

In step S742, an actual tone color is switched to one corresponding to a tone color number displayed at that time. More specifically, the content (coinciding with the tone color number displayed at that time) of the operation register TWORK1 of the data/work RAM 6 is written in the tone color register SND.

In step S743, a count value corresponding to the time t for fixing selection of a tone color number is set in the counter CNT2, and the flow then returns to the panel processing subroutine shown in FIG. 11.

FIG. 13 is a flow chart showing a subroutine of the selector ON processing (step S75) in the panel processing shown in FIG. 11.

In this processing, it is checked in step S7501 if an assigner mode is ON.

The assigner mode is a mode for, when the selector 2*a* is operated, reading out and displaying tone color numbers which are previously used. When tone color assign processing (see FIGS. 17A and 17B; to be described later) is executed after an elapse of the predetermined time t from an OFF event of a given selector, an assigner ON flag is set to enable this mode. When the selector 2*a* is operated while this mode is not ON, only a normal numerical value incrementing function is enabled.

As described above, when the selector 2*a* is operated after the elapse of the predetermined time t from an operation of a given selector, since the assigner mode is ON, read access of the tone color assign memory TARAM is performed, as will be described later. On the other hand, when an ON operation of the remaining selectors 2*b* to 2*d* is performed, since the assigner ON flag for enabling the assigner mode is cleared in step S7503 (to be described later), the assigner mode is kept OFF before the elapse of the predetermined time t after the operation of the remaining selectors 2*b* to 2*d*. Therefore, in this case, even when the selector 2*a* is operated, no read access of the tone color assign memory TARAM is performed, and only a normal numerical value incrementing function is enabled as described above.

If it is determined in step S7501 that the assigner mode is not ON, the flow advances to step S7504, and the content of the tone color register SND, which coincides with a tone color number displayed at that time, is written in the operation register TWORK1. In step S7505, one of addends "+1", "−1", "+10", and "−10" corresponding to one of the selectors 2*a* to 2*d*, which is turned on at that time, is written in another operation register TWORK2. Thereafter, the flow advances to step S7513.

On the other hand, if it is determined in step S7501 that the assign mode is set, the flow advances to step S7502 to check if the operated selector is the selector 2*a*. If it is determined in step S7502 that the operated selector is other than the selector 2*a*, i.e., one of the selectors 2*b* to 2*d*, the assigner ON flag is cleared in step S7503, and the flow advances to step S7504 described above.

If it is determined in step S7502 that the operated selector is the selector 2*a*, the flow then advances to step S7506 to increment the read (read-out) address of the tone color assign memory TARAM by "1", and the flow advances to step S7507.

In step S7507, it is checked if the read address of the tone color assign memory TARAM exceeds a limit, i.e., a 10th address in this embodiment. If YES in step S7507, the flow advances to step S7503 described above.

On the other hand, if it is determined in step S7507 that the read address is smaller than the limit, the flow advances to step S7508 to read out a use frequency corresponding to the read address from the tone color assign memory TARAM. In step S7509, it is checked if the use frequency is "00". If the use frequency read out in step S7508 is "00", since no previously used tone color number is stored at the read address incremented by "1" in step S7506, the flow advances to step S7503 described above.

If it is determined in step S7509 that the use frequency is not "00", the flow advances to step S7510, and a tone color number stored at the read address incremented by "1" in step S7506 is read out from the tone color assign memory TARAM.

It is then checked in step S7511 if the readout tone color number coincides with the tone color number displayed at that time. This processing is to prevent a repetitive display operation of the tone color number when the tone color number stored at the start address of the tone color assign memory TARAM coincides with the tone color number displayed at that time. If it is determined in step S7511 that the readout tone color number coincides with the number stored in the tone color register SND (coinciding with the tone color number displayed at that time), the flow returns to step S7506 to increment the read address of the tone color assign memory TARAM by "1", thus repeating the processing.

If it is determined in step S7511 that the readout tone color number does not coincide with the number stored in the tone color register SND, the flow advances to step S7512, and the readout tone color number is stored in the operation register TWORK1. Thereafter, the flow advances to step S7513.

In step S7513, a PUSH flag indicating that a selector is an ON state is set (SREG1). In step S7514, a predetermined value is set in the counter CNT1 for counting an ON time of the selector. After tone color number change processing (see FIG. 16; to be described later) is executed in step S7515, the tone color number stored in the operation register TWORK1 at that time is written in the display data register LEDREG to display the tone color number in step S7516. Thereafter, the flow returns to the panel processing routine shown in FIG. 11.

Figure 14:
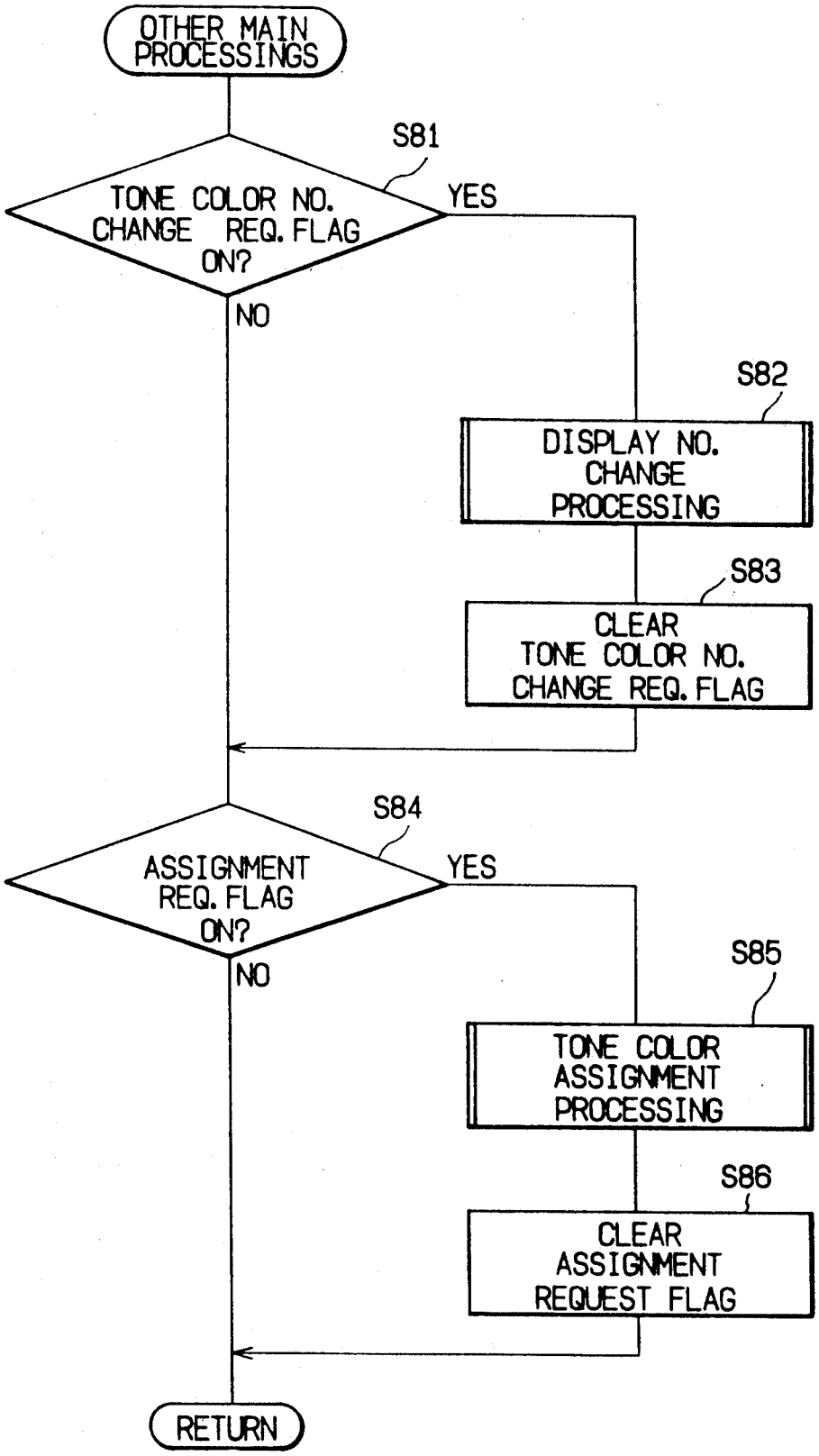

FIG. 14 is a flow chart showing a subroutine of other main processing operations (step S8) in the main processing in FIG. 9.

In this processing, in step S81, it is checked if a tone color number change request flag set in timer processing (FIG. 18; to be described later) is set. The tone color number change request flag is set when a predetermined time $t_1$ passes while a given selector is kept in an ON state. If the tone color change request flag is set, the flow advances to step S82, and display number change processing (FIG. 15; to be described later) is performed. In step S83, the tone color number change request flag is cleared, and the flow advances to step S84.

However, if it is determined in step S81 that the tone color number change request flag is not set, the flow directly advances to step S84.

It is checked in step S84 if an assignment request flag is set. The assignment request flag is also set in the timer processing (to be described later). This flag is set when the predetermined time t passes after an OFF event of a given selector If it is determined in step S84 that the assignment request flag is set, tone color assignment processing (see FIG. 16; to be described later) is performed in step S85. Thereafter, the assignment request flag is cleared in step S86, and the flow then returns to the main routine shown in FIG. 9.

If it is determined in step S84 that no assignment request flag is set, the flow directly returns to the main routine shown in FIG. 9.

Figure 15:
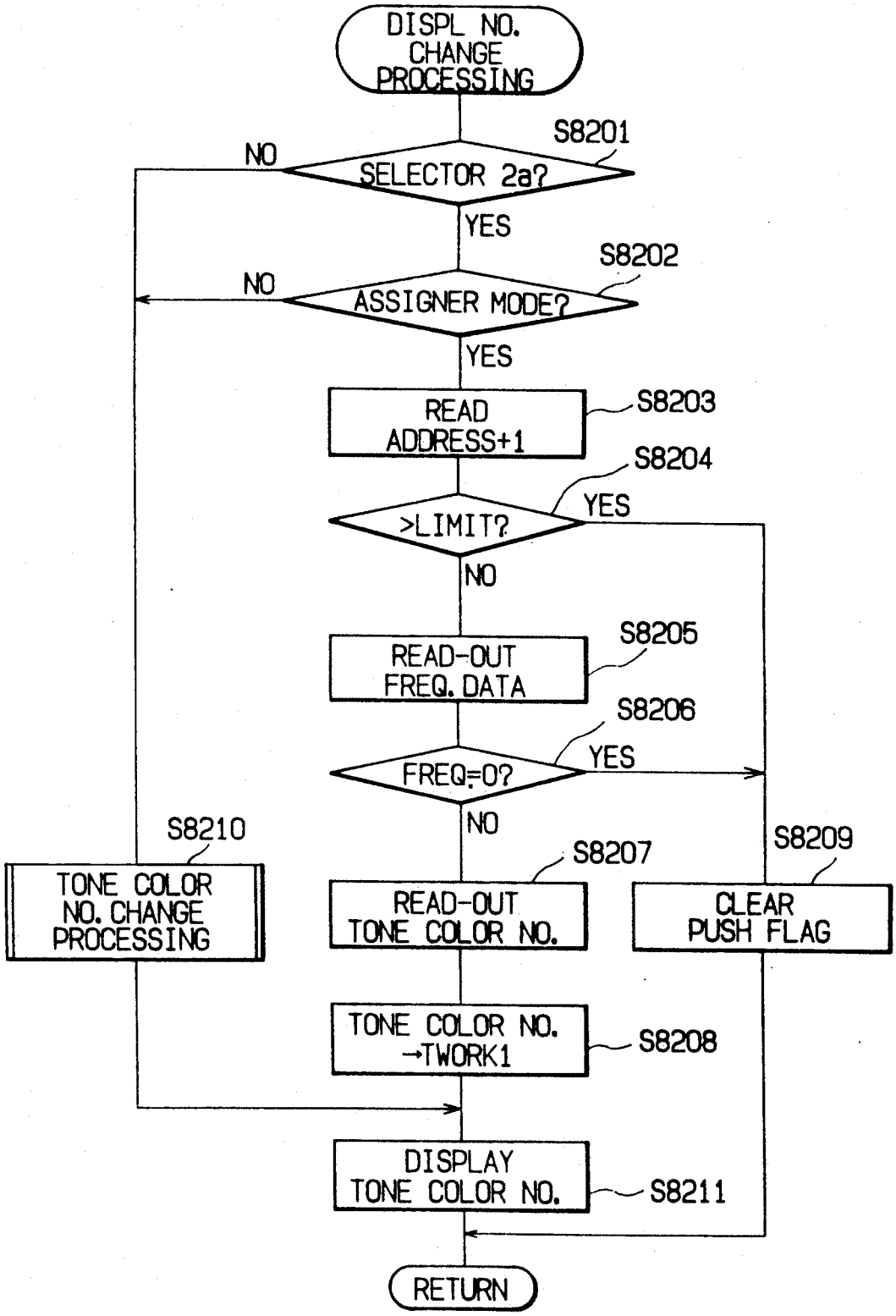

FIG. 15 is a flow chart showing a subroutine of the display number change processing (step S82) in the other main processing operations in FIG. 14.

In this processing, it is checked in step S8201 if the ON selector is the selector 2a. If YES in step S8201, the flow advances to step S8202 to check if the assigner mode is ON. If YES in step S8202, the flow advances to step S8203. In step S8203 and subsequent steps S8204 to S8208, the same processing operations as in steps S7506 to S7512 in the selector ON processing (FIG. 13) described above are performed, and the flow then advances to step S8211. With this processing, when the selector 2a is continuously depressed, tone color numbers can be sequentially read out from the tone color assign memory TARAM, and can be displayed.

If it is determined in step S8204 that the read address of the tone color assign memory TARAM exceeds the limit, or if it is determined in step S8206 that the readout use frequency is "00", the flow advances to step S8209 to clear the PUSH flag, and the flow then returns to the other main processing routine in FIG. 14. Therefore, in this case, no read access of the tone color assign memory TARAM is performed, and neither tone color number change processing nor display processing are performed.

If it is determined in step S8201 that the ON selector is not the selector 2a, or if it is determined in step S8202 that the assigner mode is not ON, the flow advances to step S8210 to execute tone color change processing (see FIG. 16; to be described later), and the flow then advances to step S8211.

In step S8211, the same processing as the tone color number display processing in step S7516 in the selector ON processing shown in FIG. 13 is executed, and the flow then returns to the other main processing routine in FIG. 14.

Figure 16:
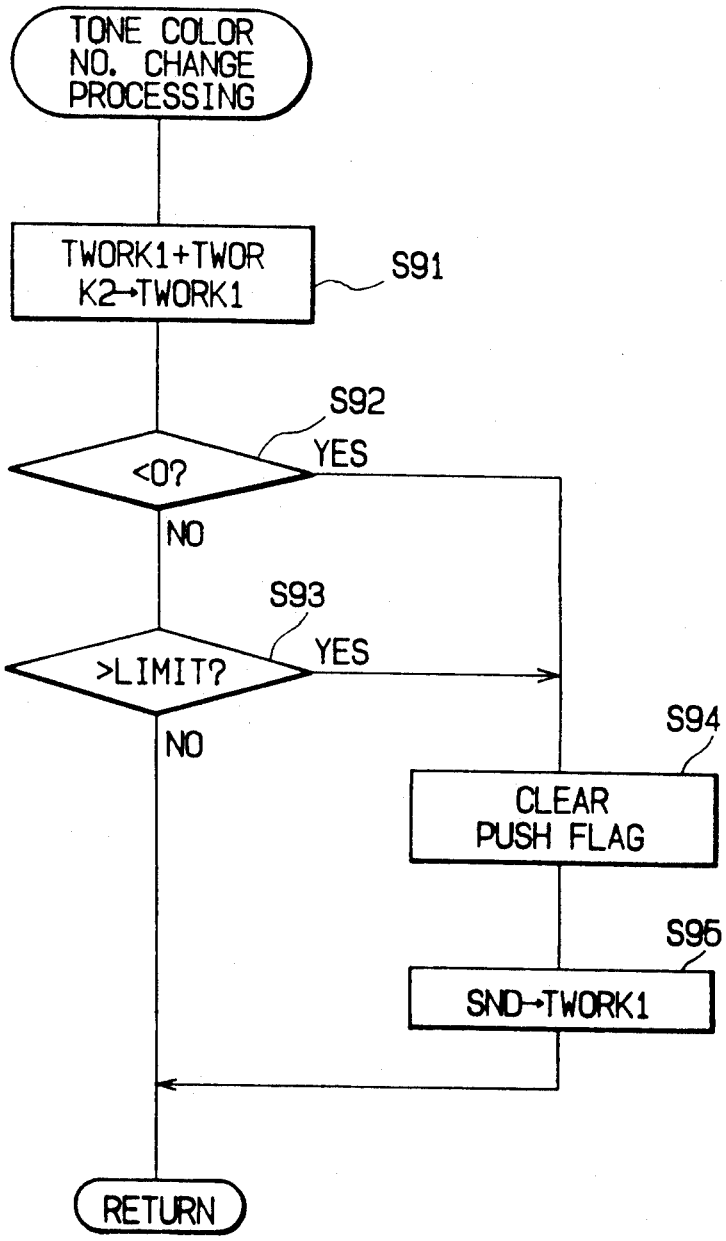

FIG. 16 is a flow chart showing a subroutine of the tone color number change processing executed in step S7512 in the selector ON processing in FIG. 13, and in step S8208 in the display number change processing in FIG. 15.

In this processing, in step S91, the content of the operation register TWORK2 is added to the content of the operation register TWORK1, and the sum is written in the operation register TWORK1. Before this updating operation, the operation register TWORK1 stores a tone color number displayed at that time, and the operation register TWORK2 stores one of the addends "+1", "−1", "+10", and "−10" corresponding to an operated one of the selectors 2a to 2d. Therefore, when the contents of these registers are added to each other, a new tone color number can be obtained.

It is then checked in step S92 if the new tone color number is a negative value. If NO in step S92, it is checked in step S93 if the new tone color number exceeds an upper limit, e.g., "99".

If it is determined in these steps that the new tone color number is a negative value, or exceeds the upper limit, the flow advances to step S94 to clear the PUSH flag set in the selector ON processing shown in FIG. 13, and in step S95, the tone color number stored in the operation register TWORK1 at that time is restored to the content of the tone color register SND. Thereafter, the flow returns to the main routine.

Therefore, in the electronic musical instrument of this embodiment, when a display of a tone color number exceeds a range of "00" to "99" by intermittently or continuously depressing the selectors 2a to 2d, the display is stopped at a value displayed at that time.

If it is determined in step S93 that the new tone color number does not exceed the upper limit, the flow returns to the main routine.

Figure 17A:
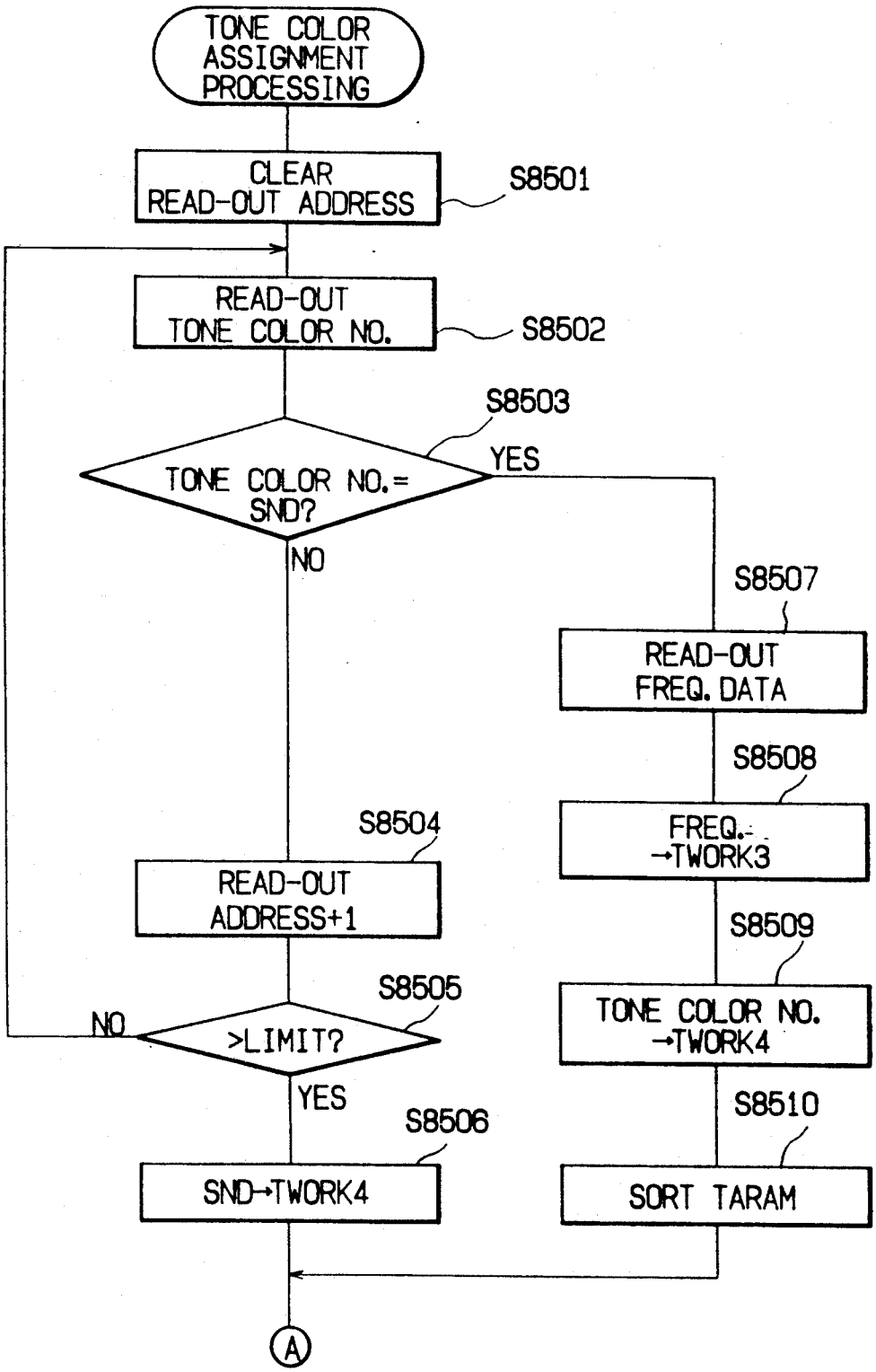
Figure 17B:
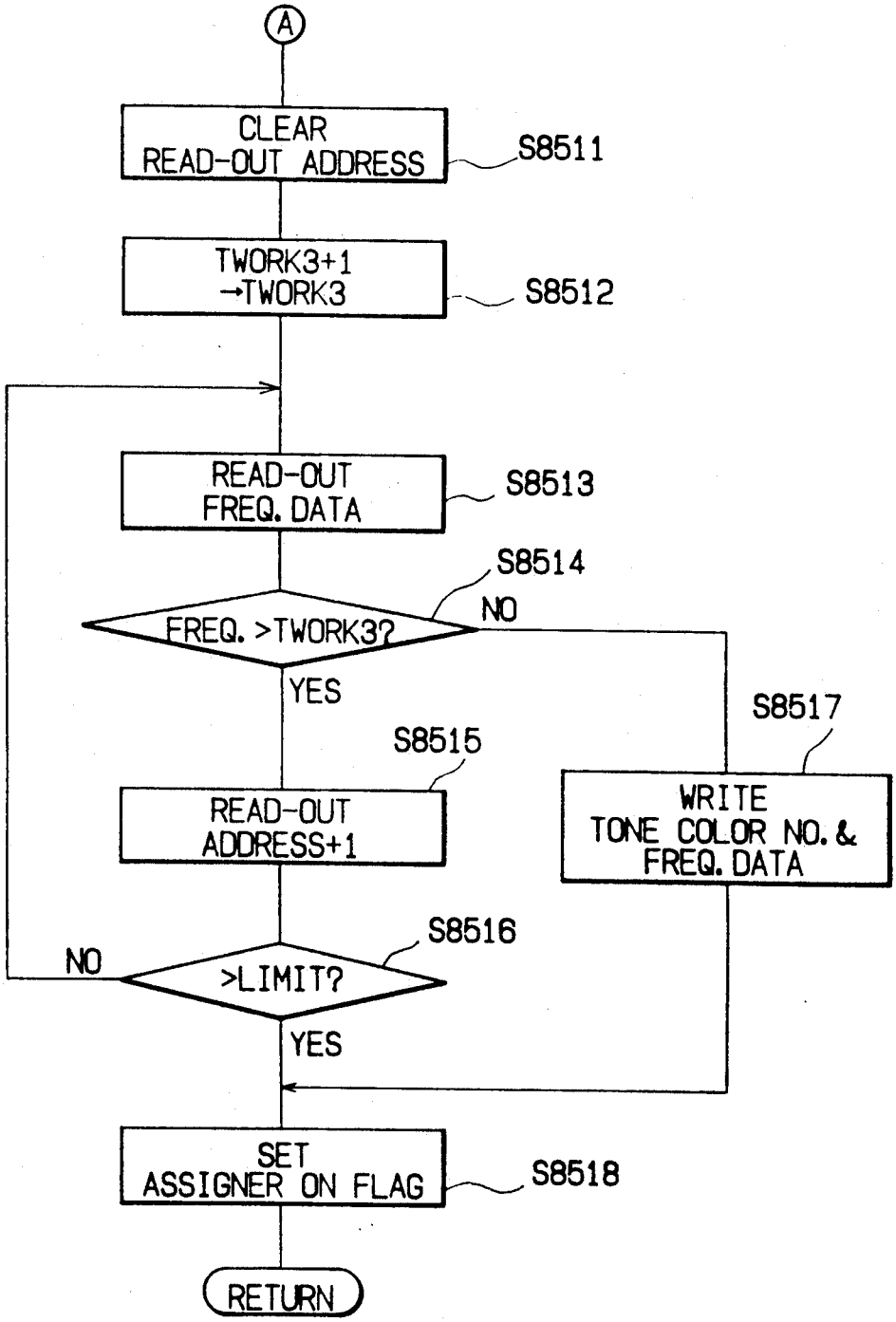

FIGS. 17A and 17B are flow charts showing a subroutine of the tone color assignment processing (step S85) in the other main processing routine shown in FIG. 14.

In this processing, the number of a selection-fixed tone color is written at a predetermined address of the tone color assign memory TARAM.

In this processing, processing for checking if a tone color number to be written in the tone color assign memory TARAM is already stored in the tone color assign memory TARAM is executed. More specifically, in step S8501, the read address of the tone color assign memory TARAM is temporarily cleared and initialized.

In step S8502, a tone color number stored in the tone color assign memory TARAM is read out from the start address. It is then checked in step S8503 if the readout tone color number coincides with a tone color number stored in the tone color register SND, i.e., a tone color number whose selection is fixed presently. If it is determined in step S8503 that the readout tone color number does not coincide with the tone color number whose selection is fixed presently, the flow advances to step S8504 to increment the read address by "1". It is then checked in step S8505 if the read address exceeds a limit, e.g., a 10th address in this embodiment. If NO in step S8505, the flow returns to step S8502 to read out a tone color number from the next read address.

If it is determined in step S8505 that the read address exceeds the limit, since the tone color number whose selection is presently fixed is not stored in the tone color assign memory TARAM, the flow advances to step S8506 to clear and initialize the frequency register TWORK3 for storing a use frequency in step S8508 (to be described later). In addition, the content of the tone color register SND as a tone color number to be written presently is written in the number register TWORK4 for storing a tone color number in step S8509 (to be described later). Thereafter, the flow advances to step S8511.

If it is determined in step S8503 that the tone color number read out from the tone color assign memory TARAM coincides with the tone color number stored in the tone color register SND, the flow advances to step S8507, and a use frequency corresponding to the tone color number is read out from the tone color assign memory TARAM. In step S8508, the readout use frequency is stored in the frequency register TWORK3. Thereafter, in step S8509, the readout tone color number is stored in the number register TWORK4. In step S8510, the content at the address of the readout tone color number in the tone color assign memory TARAM is temporarily deleted, and the contents at the following addresses are shifted upward one by one, thereby sorting the storage contents of the tone color assign memory TARAM. Thus, the tone color number read out to the number register TWORK4 is no longer present in the tone color assign memory TARAM. Thereafter, the flow advances to step S8511.

From step S8511, processing for searching an address of the tone color assign memory TARAM at which the tone color number is to be written, and writing the tone color number at the searched address is started.

In step S8511, the read address of the tone color assign memory TARAM is temporarily cleared and initialized.

In step S8512, a value of the use frequency stored in the frequency register TWORK3 in step S8508, or a value (i.e., "00") initialized in step S8506 is incremented by "1".

In step S8513, the use frequency of the tone color number stored in the tone color assign memory TARAM is read out from the first address.

It is then checked in step S8514 if the readout use frequency is larger than a value stored in the frequency register TWORK3. If YES in step S8514, this means that the use frequency of the tone color number whose selection is presently fixed is smaller than the use frequency of the tone color number stored at that address, and the tone color number whose selection is presently fixed must be written at an address after the address. Therefore, the flow advances to step S8515, and the read address is incremented by "1". In step S8516, it is checked if the incremented read address exceeds the limit. If NO in step S8516, the flow returns to step S8513 to read out a use frequency from the next read address.

If it is determined in step S8516 that the read address exceeds the limit, this means that the use frequency of the tone color number whose selection is presently fixed is smaller than use frequencies of all the tone color numbers stored in the tone color assign memory TARAM. Therefore, no write access of the tone color assign memory TARAM is performed, and the flow advances to step S8518 to set the above-mentioned assigner ON flag. Thereafter, the flow returns to the other main processing routine in FIG. 14. Note that the read address of the tone color assign memory TARAM is cleared when it exceeds the limit.

If it is determined in step S8514 that the readout use frequency is not larger than the value stored in the frequency register TWORK3, the flow advances to step S8517, and tone color number & use frequency write processing is performed. In the tone color number & frequency write processing, contents at addresses after the read address of the use frequency at this time are shifted downward one by one. Thus, since a read address becomes empty, the contents of the number register TWORK4 and the frequency register TWORK3 are written at the empty address. Thereafter, the flow advances to step S8518.

FIG. 18 is a flow chart showing a routine of timer processing executed as an interrupt routine for the main routine shown in FIG. 9.

This processing is executed at the beginning of each clock. In step S1001, it is checked if the PUSH flag set in the selector ON processing shown in FIG. 13 is set. If YES in step S1001, the flow advances to step S1002 to decrement the value of the counter CNT1 by "1". Thereafter, in step S1003, it is checked if the value of the counter CNT1 has reached 0. If YES in step S1003, the tone color number change request flag is set in step S1004, and the flow then advances to step S1005.

If it is determined in step S1001 that the PUSH flag is not set, or if it is determined in step S1003 that the value of the counter CNT1 has not reached 0, the flow directly advances to step S1005.

It is checked in step S1005 if the OFF request flag set in the selector OFF processing shown in FIG. 12 is set. If YES in step S1005, the flow advances to step S1006 to decrement the value of the counter CNT2 by "1". Thereafter, in step S1007, it is checked if the value of the counter CNT2 has reached 0. If YES in step S1007, the assignment request flag is set in step S1008, and the flow advances to step S1009 to execute other timer processing. Thereafter, the flow returns to the main routine shown in FIG. 9.

If it is determined in step S1005 that the OFF request flag is not set, or if it is determined in step S1007 that the value of the counter CNT2 has not reached 0, the flow directly advances to step S1009, and thereafter, returns to the main routine shown in FIG. 9.

The embodiment in which the present invention is applied to a tone color selection apparatus in an electronic musical instrument has been described. However, the present invention is not limited to the above embodiment, and various modifications can be made on the basis of the technical idea of the present invention.

In the above embodiment, the present invention is applied to the tone color selection apparatus. However, the present invention may be applied to data selection apparatuses for various tone control factors other than tone color data such as rhythm data, auto-play pattern data, auto-accompaniment pattern data, combination pattern data of various instruments, and the like. In addition, the present invention may be applied to a data selection apparatus which can switch these tone control factors, and is arranged common to these factors.

In the above embodiment, the selector 2*a* of the selectors 2*a* to 2*d* as the select operation means 101 for selecting a tone color number has a function of the read operation means 103. However, the select operation means 101 and the read operation means 103 may be independent buttons.

Furthermore, in the above embodiment, the tone color assign memory TARAM as the selection code memory 102 stores a maximum of 10 tone color numbers, and all the 10 tone color numbers are read out. However, for example, the tone color assign memory TARAM may store a larger number of tone color numbers, and 10 numbers having higher use frequencies may be read out from the memory.

In this invention, a selection code assigned to each data is not limited to a number like in the embodiment, but may be a symbol such as alphabets.

As a means for fixing selection of a selection code, a special button for fixing selection of the selection code may be arranged, and selection may be fixed by detecting an operation of this button in addition to a method of detecting an elapse of the predetermined time t from an OFF event of the selectors 2*a* to 2*d*.

In a data selection apparatus for an electronic musical instrument according to the present invention, selection codes of data which are previously used by a user are stored in the selection code memory in the order of higher use frequencies, and when the user operates the read operation means, a predetermined number of selection codes stored in the selection code memory are read out in the order of higher use frequencies.

Therefore, in this case, data frequently used by the user are preferentially presented to a user by, e.g., displaying them on a display unit or actually producing them, and the user can quickly and easily select the data.

According to the data selection apparatus for the electronic musical instrument of the present invention, when a user fixes selection of given data, a selection code of the data is automatically written at a predetermined address of the selection code memory in accordance with a use frequency of the data. Therefore, a user need not instruct a write operation every time he or she fixes selection, resulting in very easy and convenient operations.

What is claimed is:

1. A data selection apparatus for an electronic musical instrument stores a plurality of musical data for generating musical tones, comprising:

select operation means for choosing a selection code corresponding to each of the plurality of musical data;

selection code memory means for storing the chosen selection codes;

selection code read means for reading the chosen selection codes corresponding to each of the plurality of musical data stored in said selection code memory means in an order determined by a use frequency of each of the plurality of musical data and selecting one of the plurality of musical data;

assignment means for assigning the selection code corresponding to the selected one of the plurality of musical data to a tone generator for generating the musical tones; and frequency updating means for updating the use frequency of the selected one of the plurality of musical data.

2. The data selection apparatus of claim 1, further comprising:

read operation means for performing a read operation;

wherein said selection code read means reads out the chosen selection codes corresponding to each of the plurality of musical data stored in said selection code memory means in an order determined by a magnitude of the use frequency of the plurality of musical data in a response to the read operation by said read operation means.

3. The data selection apparatus of claim 1, further comprising display means for displaying the selection codes read out from said selection code memory means by said selection code read means.

4. The data selection apparatus of claim 1, wherein said select operation means and said read operation means, together constitute operation detection means, said operation detection means further including detection means for detecting a first operation of said select operation means after an elapse of a first predetermined time, and a series of operations of said select operation means within a second predetermined time after the first operation.

5. The data selection apparatus of claim 2, wherein said select operation means includes a pair of buttons for respectively incrementing and decrementing a ones digit of the chosen selection code represented by a two-digit numerical value by one, and a pair of buttons for respectively incrementing and decrementing a tens digit of the chosen selection code by one.

6. The data selection apparatus of claim 5, wherein said read operation means increments the ones digit of the chosen selection code by one using the ones digit incrementing button, and detects the first operation of the ones digit incrementing button after an elapse of a first predetermined time, and a series of operations of the ones digit incrementing button within a second predetermined time after the first operation.

7. The data selection apparatus of claim 6, wherein when a series of operations of said read operation means reaches a predetermined number, and all the selecting codes stored in said selection code memory means are read out, said operation detection means detects an operation of the ones digit incrementing button as an operation of said select operation means.

8. The data selection apparatus of claim 5, wherein when the ones digit incrementing button is operated after an operation of the ones digit decrementing button, an operation of the tens digit incrementing button, or an operation of the tens digit decrementing button, said operation detection means detects the operation of the ones digit incrementing button as an operation of said select operation means.

9. The data selection apparatus of claim 1, wherein said selection code memory means stores a predetermined number of the plurality of musical data, each including a corresponding selection code and use frequency.

10. The data selection apparatus of claim 1, further comprising selection code write means for writing the use frequency updated by said frequency updating means and the corresponding selection code in said selection code memory means in an order determined by a magnitude of the use frequency of the plurality of musical data.

11. The data select apparatus of claim 1, wherein said assignment means assigns the selection code after an elapse of a predetermined period of time from an operation of said select operation means, assigns the selection code to said tone generator, and initiates said frequency updating means to update the use frequency.

12. The data selection apparatus of claim 1, further comprising a keyboard, including a plurality of keys, said tone generator forming musical tones from a PCM sound source generated from performance data obtained from operation of the plurality of keys, and wherein the selection code is assigned to said tone generator as a code for selecting a tone color.

13. The data selection apparatus of claim 1, wherein the selection codes are assigned to at least one of a rhythm data group, an auto-play data group, and an auto-accompaniment data group, each of which includes a plurality of types of data.

14. The data selection apparatus of claim 2, wherein the selection codes corresponding to each of the plurality of musical data are read by said selection code read means in decreasing order of the magnitude of the use frequency of the plurality of musical data.

15. A data selection apparatus for an electronic musical instrument, comprising:

memory means for storing a plurality of musical tone data, each including a musical number and a use frequency;

operation panel means, including a plurality of selectors for selecting one of the plurality of musical tone data and display means for displaying the musical number of the selected one of the plurality of musical tone data;

assigning means for assigning the one of the plurality of musical tone data selected by one of the plurality of selectors, to a tone generator to produce a musical tone; and incrementing means for incrementing the use frequency of the selected one of the plurality of musical tone data;

wherein said operating panel means displays the plurality of musical tone data in an order determined by a magnitude of the use frequency of each of the plurality of musical tone data.

16. The data selection apparatus of claim 15, wherein the musical number of each of the plurality of musical tone data are displayed by said operating panel means in decreasing order of magnitude of the use frequency of each of the plurality of musical tone data.

17. The data selecting apparatus of claim 15, wherein each of the plurality of selectors increments or decrements the musical number displayed on said display means by a predetermined amount when none of the plurality of musical tone data has a use frequency greater than zero and wherein one of the plurality of selectors selects all of the plurality of musical tone data having a use frequency greater than zero, in the order determined by the magnitude of the use frequency for each of the plurality of musical tone data.

18. The data selecting apparatus of claim 17, wherein when more than one of the plurality of musical tone data has the same use frequency, the more than one of the plurality of musical tone data are selected in an order determined by when each use frequency was incremented by said incrementing means.

19. The data selecting apparatus of claim 15, wherein the musical number for each of the plurality of musical tone data has an upper and lower limit and the plurality of selector can only select a musical number between the upper and lower limit.

20. A method of selecting data for generating a musical tone in an electronic musical instrument, comprising the steps of:

a) storing a plurality of musical tone data, each including a musical number and a use frequency;

b) selecting one of the plurality of musical tone data, utilizing a plurality of selectors, and displaying the musical number of the selected one of the plurality of musical tone data;

c) assigning the one of the plurality of musical tone data selected by the plurality of selectors to a tone generator to produce the musical tone; and d) incrementing the use frequency of the selected one of the plurality of musical tone data;

wherein said step (b) displays the plurality of musical tone data in an order determined by a magnitude of the use frequency of each of the plurality of musical tone data.

21. The method of claim 20, wherein step (b) displays the musical number of each of the plurality of musical tone data in decreasing order of magnitude of the use frequency of each of the plurality of musical tone data.

22. The method of claim 20, wherein each of the plurality of selectors increments or decrements the musical number displayed by a predetermined amount when none of the plurality of musical tone data has a use frequency greater than zero and wherein one of the plurality of selectors selects all of the plurality of musical tone data having a use frequency greater than zero, in the order determined by the magnitude of the use frequency for each of the plurality of musical tone data.

23. The method of claim 22, wherein when more than one of the plurality of musical tone data as the same use frequency, the more than one of the plurality of musical tone data are selected in an order determined by when each use frequency was incremented.

24. The method of claim 20, wherein the musical number for each of the plurality of musical tone data has an upper and lower limit and the plurality of selectors can only select a musical number between the upper and lower limit.

* * * * *